US011081826B2

(12) United States Patent
Fujisaki

(10) Patent No.: US 11,081,826 B2
(45) Date of Patent: Aug. 3, 2021

(54) CONNECTOR HAVING OFFSET TERMINAL CONNECTING PORTIONS

(71) Applicant: Sumitomo Wiring Systems, Ltd., Mie (JP)

(72) Inventor: Ryuichi Fujisaki, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/787,096

(22) Filed: Feb. 11, 2020

(65) Prior Publication Data

US 2020/0259284 A1 Aug. 13, 2020

(30) Foreign Application Priority Data

Feb. 11, 2019 (JP) ..... JP2019-022191

(51) Int. Cl.
*H01R 13/41* (2006.01)
*H01R 4/70* (2006.01)

(52) U.S. Cl.
CPC ..... *H01R 13/41* (2013.01); *H01R 4/70* (2013.01)

(58) Field of Classification Search
CPC ..... H01R 13/41; H01R 4/70; H01R 13/5845
See application file for complete search history.

(56) References Cited

U.S. PATENT DOCUMENTS 6,815,610 B2 * 11/2004 Kuboshima ..... H01R 13/5845 174/360
8,192,212 B2 * 6/2012 Casses ..... B60L 53/16 439/181
8,545,265 B2 * 10/2013 Sakamoto ..... B29C 45/14467 439/606
8,905,770 B2 * 12/2014 Fujiwara ..... H01R 13/516 439/181
9,960,531 B2 * 5/2018 Poncini ..... H01R 13/502
2004/0057187 A1 * 3/2004 Kuboshima ..... H01R 13/5845 361/118
2017/0194738 A1 * 7/2017 Poncini ..... H01R 4/029
2020/0259276 A1 * 8/2020 Fujisaki ..... H01R 11/12
2020/0259284 A1 * 8/2020 Fujisaki ..... H01R 13/41

FOREIGN PATENT DOCUMENTS

JP 2012-104415 5/2012

* cited by examiner

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A connector (1) includes a housing (2), a first terminal (31) and a second terminal (32). The terminals (31, 32) are side by side and parallel. One end of each terminal is inserted into the housing (2) and the other end projects from the housing (2). Each of the terminals (31, 32) includes a base (33) projecting from the housing (2) and a connecting portion (34) that is wider than the base (33) toward both sides in an arrangement direction (Y) of the first and second terminals (31, 32). The connecting portion (34) of the first terminal (31) projects farther from the housing (2) than the connecting portion (34) of the second terminal (32). An insulating member (4) is at a position adjacent to the connecting portion (34) of the second terminal (32) in the arrangement direction (Y) on a surface of the base (33) of the first terminal (31).

8 Claims, 7 Drawing Sheets

CONNECTOR HAVING OFFSET TERMINAL CONNECTING PORTIONS

BACKGROUND

Field of the Invention

This disclosure relates to a connector.

Related Art

FIG. 7 of Japanese Unexamined Patent Publication No. 2012-104415 shows a connector 9 for supplying power to an in-vehicle device. The connector 9 includes a housing 92 with two cavities each of which accommodates a terminal 91. An inner wall of each cavity is formed with a locking lance that engages the terminal 91 inserted into the cavity and prevents the terminal 91 from coming out from the housing 92. One end of each terminal 91 is inserted into a cavity in the housing 92 and the other end projects out from the housing 92. A wide connecting portion 911 projects toward both sides in an arrangement direction of a pair of the terminals 91 and a projecting end part of the terminal 91 includes a bolt inserting portion 912. A bolt is inserted into the bolt inserting portion 912 to connect the terminal 91 to another conductive member.

However, if it is desired to reduce an interval between the terminals 91 in a structure shown in FIG. 7, the connecting portions 911 of the terminals 91 may be too close to each other when accuracy in mounting the terminals 91 into the housing 92 or the molding accuracy of the housing 92 is low. In this case, there is room for improvement in terms of ensuring electrical insulation between the terminals 91. Electrical insulation between the terminals 91 can be ensured if the interval between the terminals 91 is increased, but this approach enlarges the entire connector 9.

This disclosure was made in view of such a problem and aims to provide a connector capable of ensuring electrical insulation between two terminals even if an interval in an arrangement direction of the terminals is reduced.

SUMMARY

One aspect of the disclosure is directed to a connector with a housing, and first and second terminals disposed side by side to be parallel to each other. One end of each of the first and second terminals is inserted into the housing, and the other end thereof projects from the housing. Each of the first and second terminals includes a base projecting from the housing and a connecting portion that is wider than the base toward both sides in an arrangement direction of the first and second terminals. The base includes a bolt inserting portion. The connecting portion of the first terminal projects farther away from the housing than the connecting portion of the second terminal in a terminal forming direction along the first terminal and the second terminal. An insulating member is disposed at a position adjacent to the connecting portion of the second terminal in the arrangement direction on a surface of the base of the first terminal.

The connecting portion of the first terminal in the above-described connector projects farther from the housing than the connecting portion of the second terminal in the terminal forming direction. Specifically, the connecting portions of the first and second terminals are at positions deviated from each other in the terminal forming direction. Thus, the connecting portions are not too close to each other due to the side-by-side arrangement of the pair of the connecting portions in the arrangement direction. In this way, electrical insulation between the first and second terminals easily is ensured. Therefore, the connector can be reduced in size by reducing an interval between the first and second terminals in the arrangement direction.

If the interval between the first and second terminals is reduced in the arrangement direction, electrical insulation between the first and second terminals may be reduced due to the proximity of the connecting portion of the second terminal and the base of the first terminal in the arrangement direction.

Accordingly, the insulating member having electrical insulation is disposed at the position adjacent to the connecting portion of the second terminal in the arrangement direction on the surface of the base of the first terminal. Thus, even if the interval between the first and second terminals is reduced in the arrangement direction, electrical insulation between the connecting portion of the second terminal and a part of the first terminal arranged side by side in the arrangement direction can be ensured by the insulating member.

As described above, the connector ensures electrical insulation between terminals even if an interval in an arrangement direction of the terminals is reduced.

DETAILED DESCRIPTION

An embodiment of a connector is described using FIGS. 1 to 6.

Figure 1:
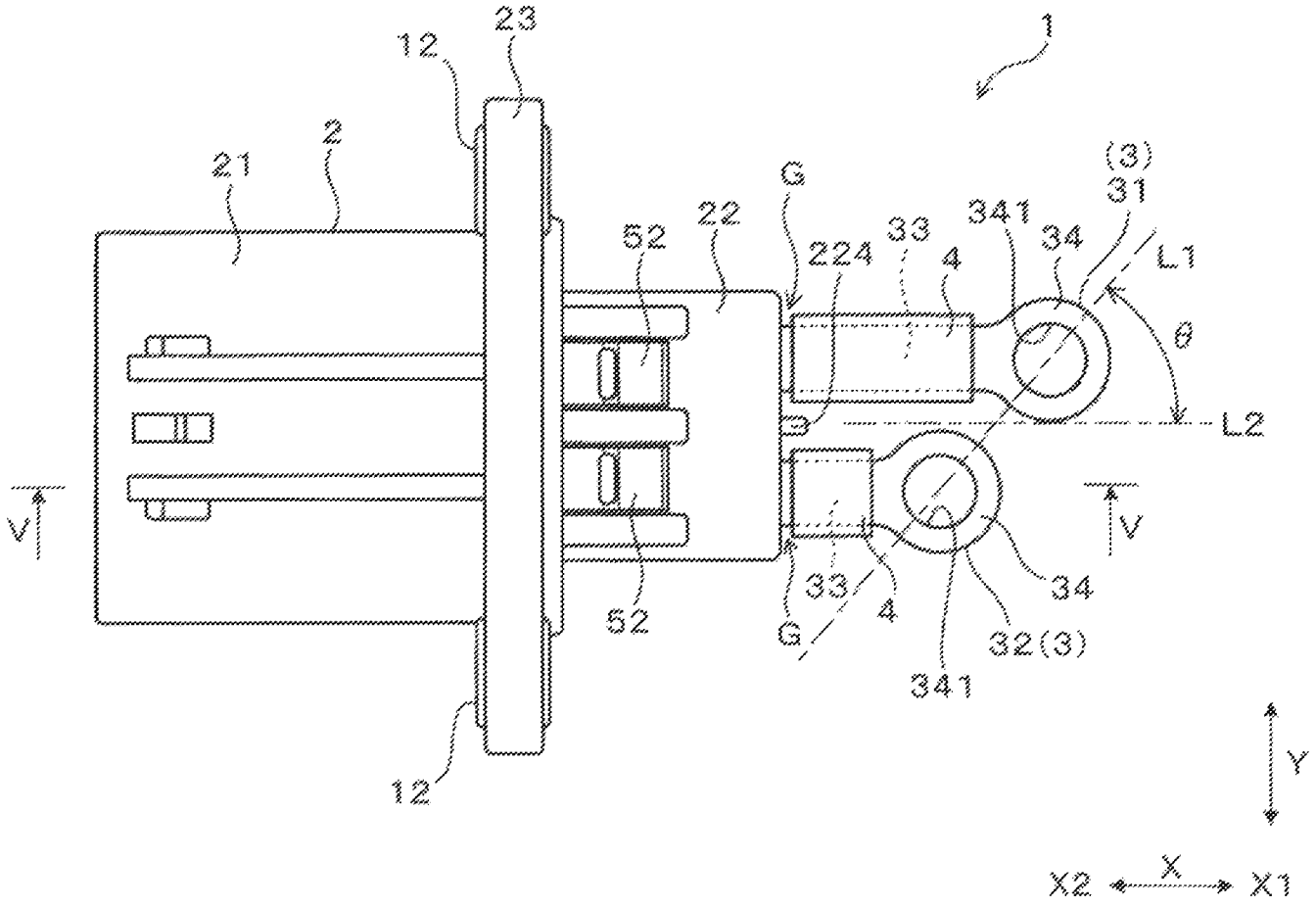
FIG. 1 is a plan view of a connector in one embodiment.
Figure 4:
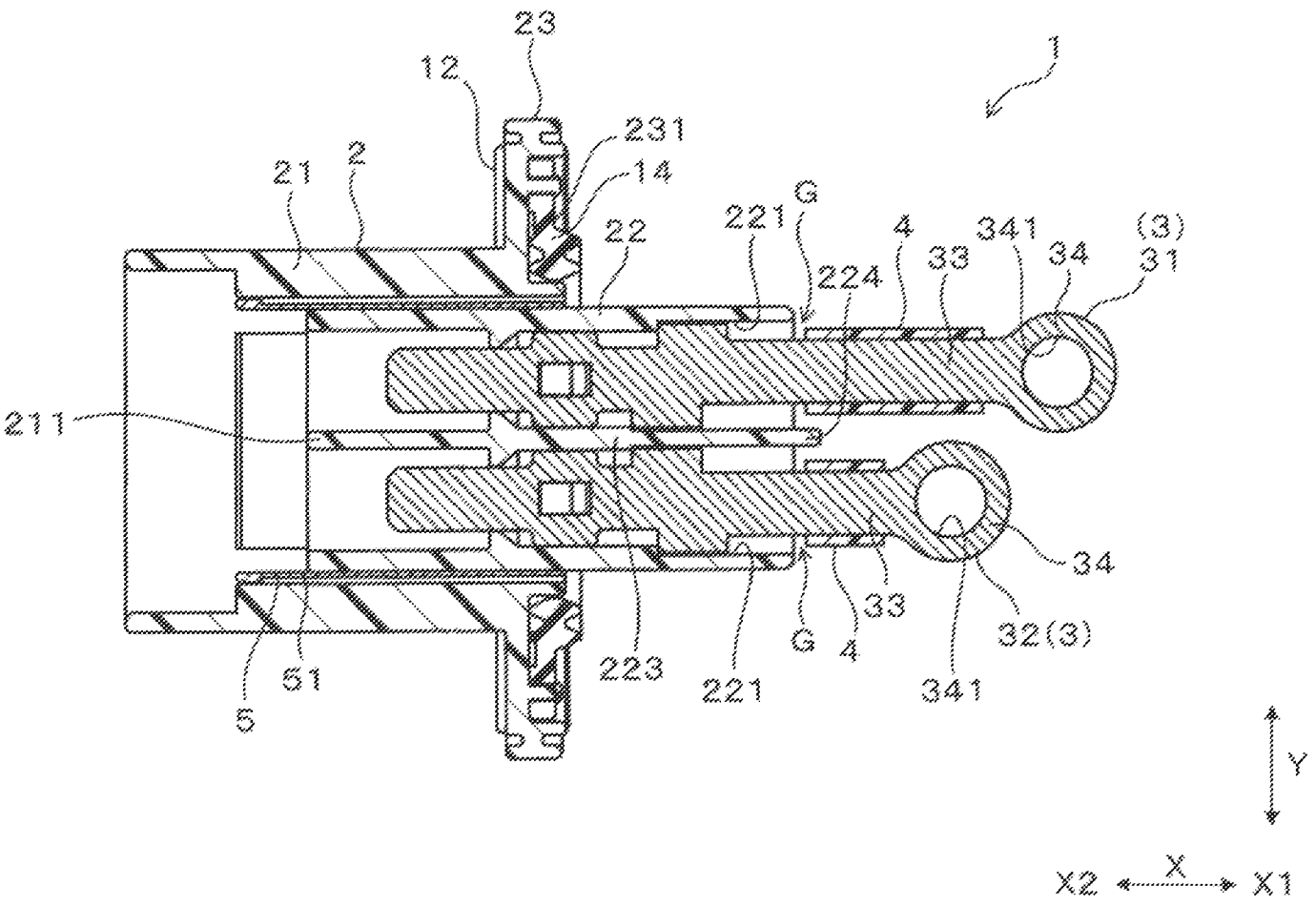
FIG. 4 is a section along IV-IV of FIG. 2.

A connector 1 of this embodiment includes a housing 2, a first terminal 31 and a second terminal 32 as shown in FIGS. 1 and 4.

The first and second terminals 31, 32 are disposed side by side to be parallel to each other. One end of each of the first and second terminals 31, 32 is inserted into the housing 2 and the other end thereof projects from the housing 2.

Each of the first and second terminals 31, 32 includes a base 33 and a connecting portion 34. The base 33 projects from the housing 2. The connecting portion 34 is wider than the base 33 toward both sides in an arrangement direction of the first and second terminals 31, 32 (hereinafter, referred to as a "Y direction") and has a bolt inserting portion 341.

The connecting portion 34 of the first terminal 31 projects farther from the housing 2 than the connecting portion 34 of the second terminal 32 in a terminal forming direction (hereinafter, referred to as an "X direction"). An insulating member 4 having electrical insulation is adjacent to the connecting portion 34 of the second terminal 32 in the Y direction on the surface of the base 33 of the first terminal 31.

The first and second terminals 31, 32 may be referred to collectively as terminals 3 herein unless otherwise noted. An end toward which the first and second terminals 31, 32 project from the housing 2 in the X direction is referred to as an X1 end, and an opposite end thereof is referred to as an X2 end. A direction orthogonal to both the X direction and the Y direction is referred to as a Z direction. A radial direction of the connector 1 centered on a center axis of the connector 1 extending in the X direction merely is referred to as a radial direction. A center axis side of the connector 1 in the radial direction is referred to as an inner peripheral side, and an opposite side thereof is referred to as an outer peripheral side. Further, an entire periphery merely means an entire periphery centered on the center axis of the connector 1 extending in the X direction.

[Connector 1]

Figure 5:
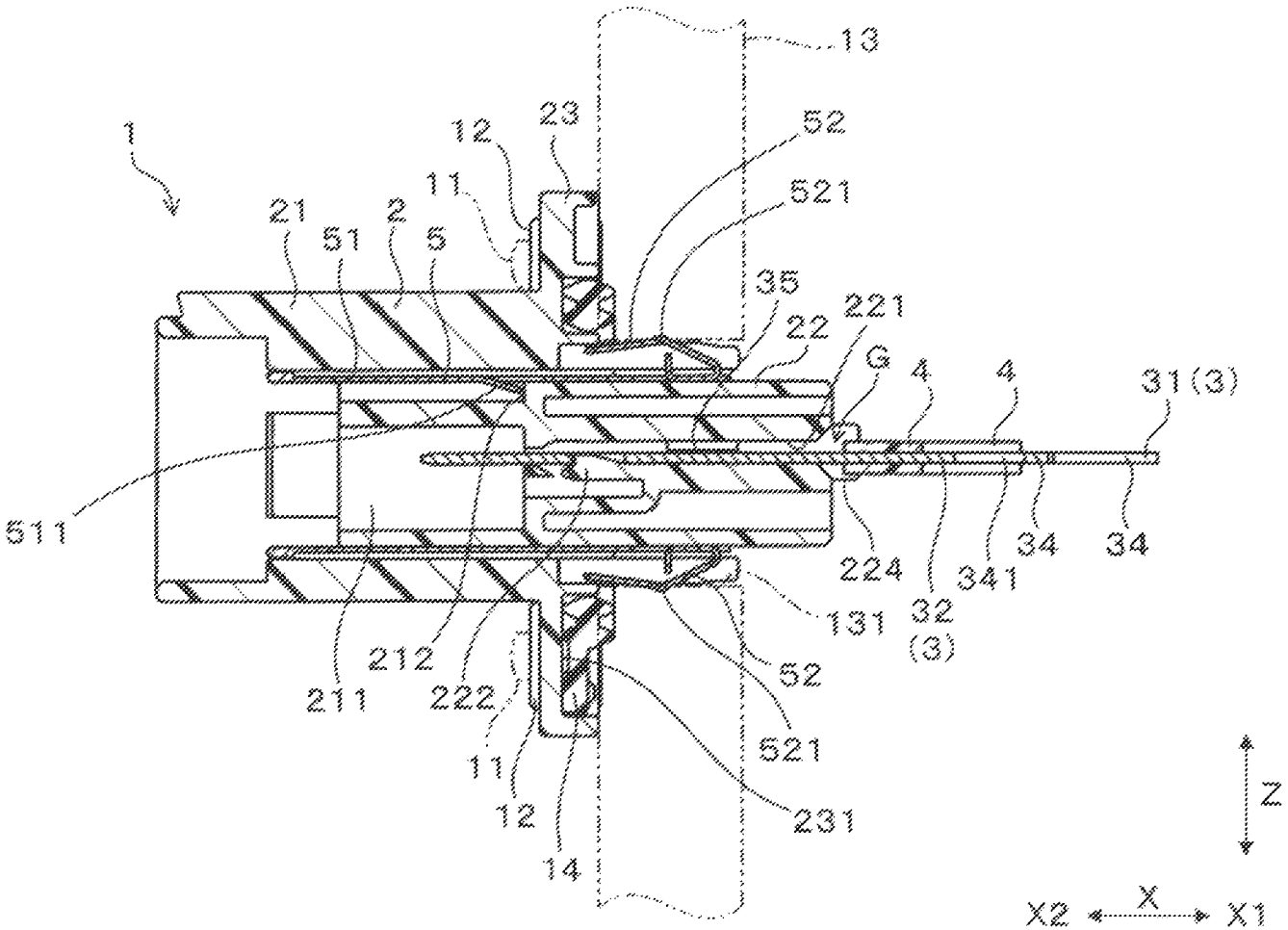
FIG. 5 is a section along V-V of FIG. 1.

As shown in FIG. 5, the connector 1 is mounted directly on a case 13 of an electrical device to be installed in an electric vehicle or the like and can relay electrical connection between an external power supply and a component disposed in the case 13.

[Housing 2]

Figure 2:
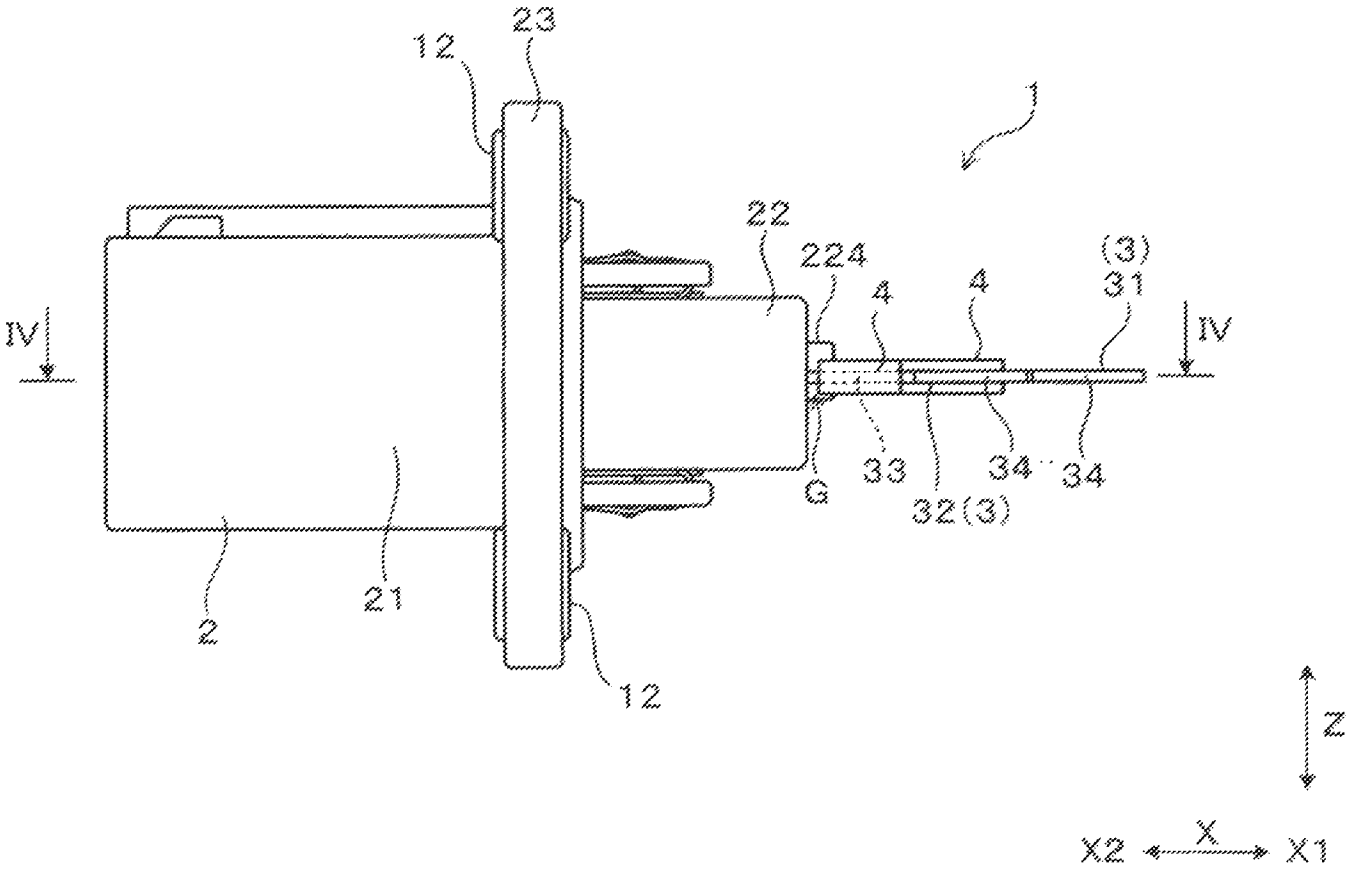
FIG. 2 is a side view of the connector in the embodiment.

The housing 2 is made of resin having electrical insulation. As shown in FIGS. 1 and 2, the housing 2 includes a mounting portion 21, a terminal inserting portion 22 and a flange 23.

As shown in FIGS. 1, 2, 4 and 5, the mounting portion 21 has a tubular shape parallel to the X direction. The mounting portion 21 is formed in an X2 end region of the housing 2. As shown in FIG. 4, parts of the first and second terminals 31 and 32 on the X2 end are exposed inside the mounting portion 21. In other words, the mounting portion 21 covers the X2 ends of the first and second terminals 31 and 32 from the outer peripheral side. A first partition wall 211 is formed inside the mounting portion 21 and partitions between the X2 ends of the first and second terminals 31 and 32.

An internal space of the mounting portion 21 is open on the X2 end, and an unillustrated mating connector is fit into the mounting portion 21 from the X2 end. With the mating connector connected to the connector 1, the X2 ends of the first and second terminals 31, 32 exposed in the mounting portion 21 are connected electrically to terminals of the mating connector. The terminal inserting portion 22 projects toward the X2 end in the mounting portion 21.

As shown in FIG. 4, the terminal inserting portion 22 includes two cavities 221. The cavities 221 are holes that penetrate through the terminal inserting portion 22 in the X direction. X2 ends of the cavities 221 communicate with the internal space of the mounting portion 21. The two cavities 221 are formed side by side in the Y direction.

Figure 6:
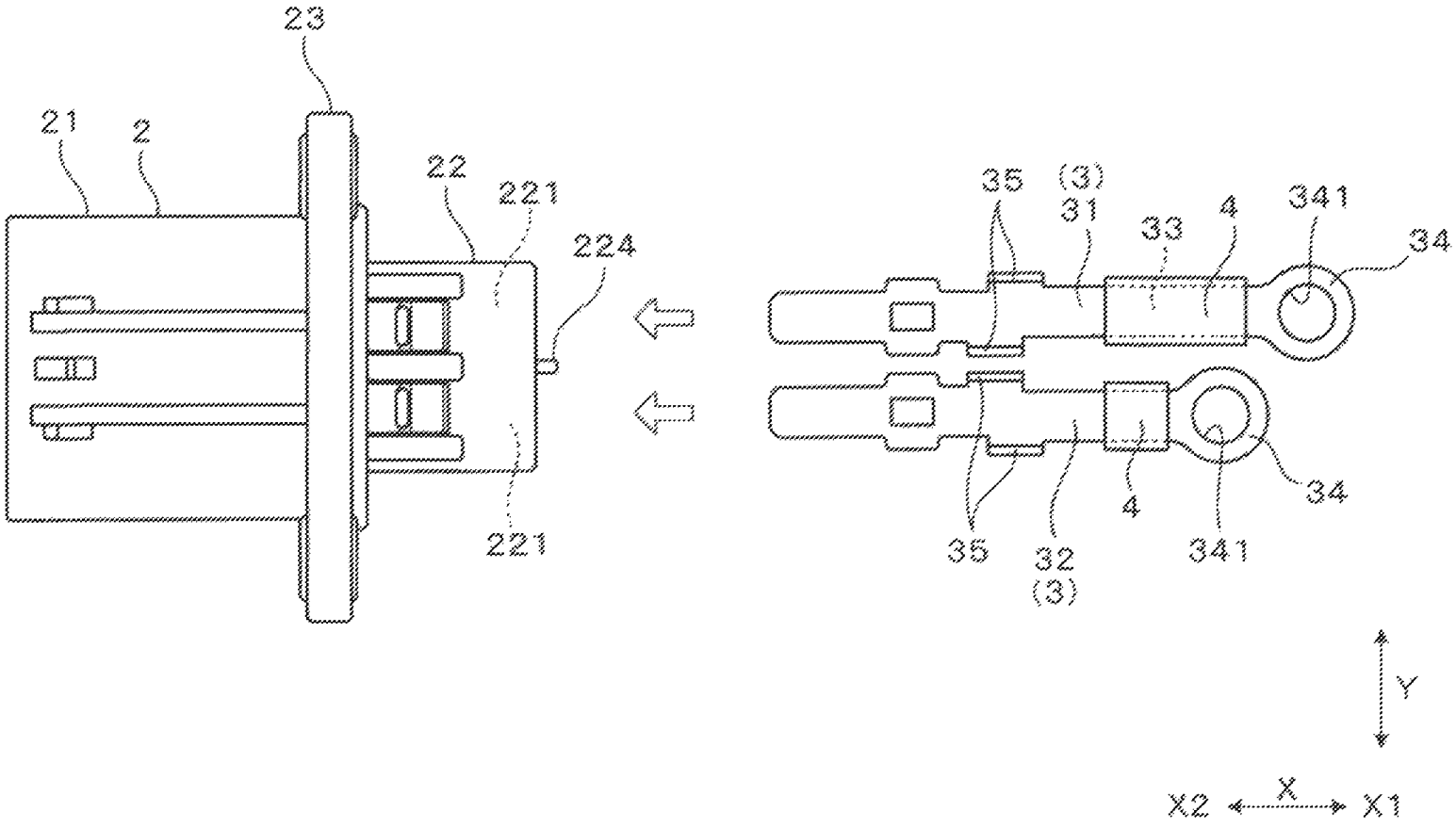
FIG. 6 is a plan view showing a state where terminals and insulating members are being inserted into the housing in the embodiment.
Figure 7:
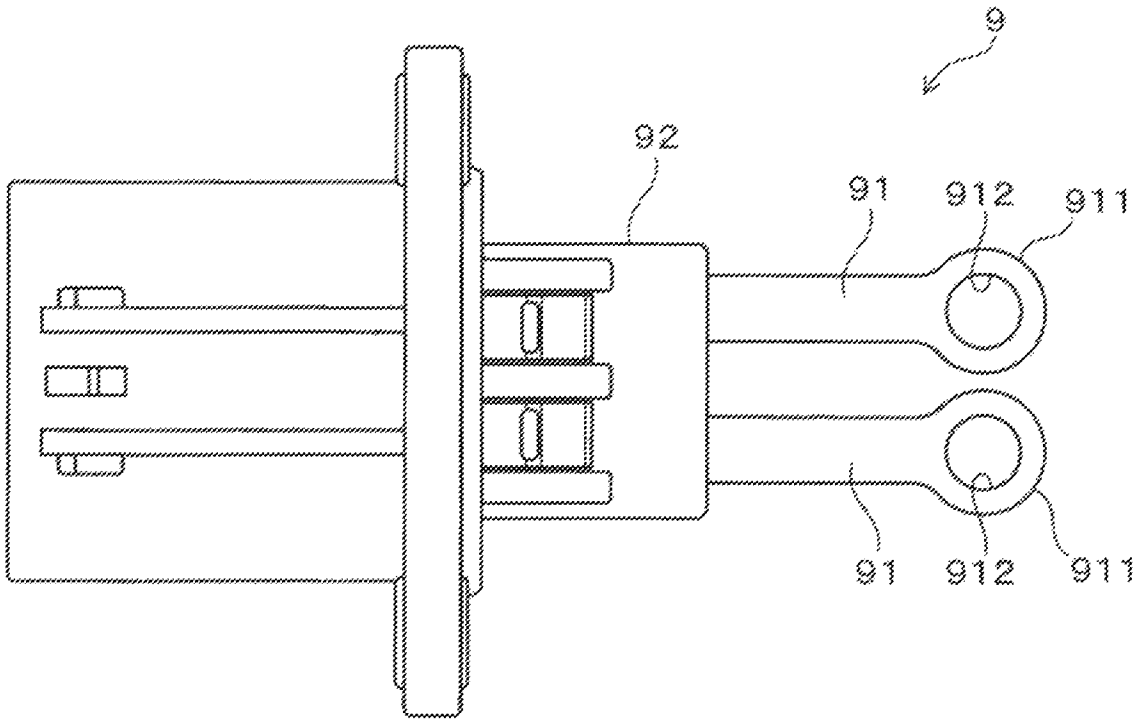
FIG. 7 PRIOR ART
FIG. 7 is a plan view of a connector in a reference embodiment.

The cavities 221 are open on the X1 side as shown in FIG. 4, and the terminals 3 are inserted therein from the X1 end, as shown in FIG. 6. Specifically, the first terminal 31 is inserted into one of the two cavities 221 and the second terminal 32 is inserted into the other.

As shown in FIG. 5, a locking lance 222 for retaining the terminal 3 is formed on a wall of the housing 2 facing the cavity 221 in the Z direction. The locking lance 222 is long in the X direction, is cantilevered toward the X2 side, and is resiliently deflectable in the Z direction.

The terminal 3 is inserted into the cavity 221 while deflecting the locking lance 222 in the Z direction. When the terminal 3 is inserted to a predetermined position in the cavity 221, the locking lance 222 is inserted into a through hole formed in the terminal 3 due to a resilient restoring force. In this way, the locking lance 222 prevents the terminal 3 inserted to the predetermined position of the cavity 221 from coming out from the cavity 221.

As shown in FIG. 4, a second partition wall 223 is formed between the two cavities 221 and partitions between the two cavities 221 arranged in the Y direction. The second partition wall 223 is continuous with the first partition wall 211 in the X direction. A rib 224 is formed on an X1 end of the second partition wall 223.

Figure 3:
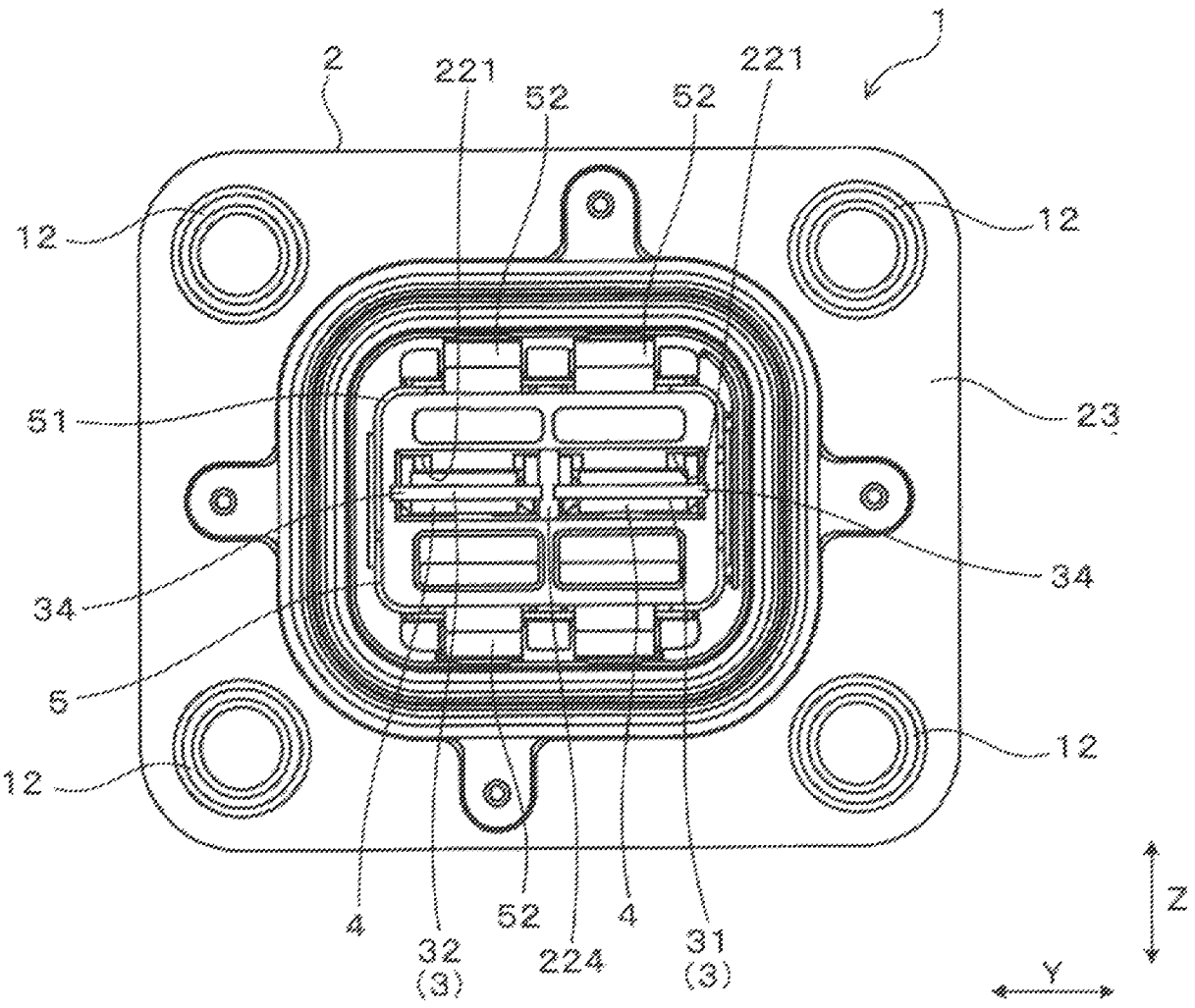
FIG. 3 is a back view of the connector in the embodiment when viewed from the side of a terminal inserting portion in a housing.

The rib 224 projects farther in the X1 direction than the X1 end openings of the cavities 221. As shown in FIGS. 3 and 4, the rib 224 is interposed between the first and second terminals 31, 32 in the Y direction. Specifically, the rib 224 is formed to overlap both the first and second terminals 31, 32 in the Y direction. As shown in FIGS. 1, 2, 4 and 5, the flange 23 is formed on a boundary between the mounting portion 21 and the terminal inserting portion 22 in the X direction.

The flange 23 projects more toward the outer peripheral side than the mounting portion 21 and the terminal inserting portion 22. As shown in FIG. 3, metal collars 12 are embedded in four corners of the flange 23 and bolts 11 of FIG. 5 are inserted through the collars 12.

As shown in FIG. 5, the case 13 has an arrangement hole 131 larger than the terminal inserting portion 22 of the connector 1 and smaller than the flange 23. The terminal inserting portion 22 of the connector 1 is inserted into the arrangement hole 131 of the case 13, and an X1 end surface of the flange 23 faces the case 13 in the X direction. The bolts 11 are inserted into the collars 12 from the X2 side of the collars 12 and threadably engage screw holes in the case 13 to fix the connector 1 to the case 13.

As shown in FIGS. 4 and 5, the X1 end surface of the flange 23 is formed with an annular accommodation groove 231 on an inner peripheral side of the collars 12 on the four corners. The accommodation groove 231 is open toward the X1 end, and an annular sealing member 14 made of rubber or the like is accommodated inside. With the connector 1 fastened to the case 13 by the bolts 11, the sealing member 14 is compressed by axial forces of the bolts 11 and is held in close contact with both the accommodation groove 231 and the case 13. In this way, sealing between the connector 1 and the case 13 is ensured.

[Terminals 3]

The first and second terminals 31, 32 are to be connected to a positive electrode and a negative electrode of the power supply, and a potential difference between these is a high potential difference of, e.g. about 600 V. As shown in FIG. 4, the first terminal 31 is inserted in one cavity 221 and the second terminal 32 is inserted in the other cavity 221. Substantially the entire terminal 3 is a plate having a thickness in the Z direction and long in the X direction. The first terminal 31 is longer than the second terminal 32.

As shown in FIG. 6, the first and second terminals 31, 32 are inserted into the cavities 221 in the X direction from the X1 end. As shown in FIG. 4, X1 ends of these terminals project into the mounting portion 21. The positions of the X2 ends of the first and second terminal 31 and 32 are aligned in the X direction.

As shown in FIGS. 5 and 6, positioning portions 35 are formed on parts of the first and second terminals 31, 32 disposed in the cavities 221. The positioning portions 35 project more toward both sides in the Y direction than surrounding parts and are bent toward in the Z direction. The positioning portions 35 position the terminals 3 with respect to the cavities 221.

As shown in FIG. 4, an X1 end of each of the first and second terminals 31, 32 projects from the cavity 221 toward the X1 end. The first terminal 31 projects more in the X direction from the cavity 221 than the second terminal 32.

Thus, the position of an X1 end of the first terminal 31 is closer to the X1 end than that of an X1 end of the second terminal 32.

A part of each of the first and second terminals 31, 32 projecting from the cavity 221 includes the base 33 and the connecting portion 34 successively from the X2 side. The base 33 is a rectangular plate long in the X direction and having a thickness in the Z direction.

The connecting portion 34 extends toward the X1 end from an X end of the base 33. The connecting portion 34 is formed on the X1 end of the terminal 3. As shown in FIGS. 1 and 4, the connecting portion 34 is wider than the base 33 to project mort toward both sides in the Y direction than the base 33. When viewed from the Z direction, the connecting portion 34 has a circular shape and the bolt inserting portion 341 penetrates through a central part of the connecting portion 34 in the Z direction. The terminal 3 is connected to another conductive member by an unillustrated bolt inserted into the bolt inserting portion 341.

The connecting portions 34 of the first and second terminals 31, 32 are formed at positions deviated from each other in the X direction. The connecting portion 34 of the first terminal 31 is closer to the X1 end than the connecting portion 34 of the second terminal 32. In this way, the connecting portion 34 of the first terminal 31 and the connecting portion 34 of the second terminal 32 are formed side by side in a direction oblique to both the X direction and the Y direction. As shown in FIG. 1, a shortest virtual straight line L1 connecting the connecting portion 34 of the first terminal 31 and the connecting portion 34 of the second terminal 32 is inclined such that an angle θ with respect to a virtual straight line L2 parallel to the Y direction preferably is smaller than 45° (i.e. 45(π/180)rad). In this case, the connecting portion 34 of the first terminal 31 and the connecting portion 34 of the second terminal 32 can be close without enlarging the connector 1.

The connecting portion 34 of the second terminal 32 is formed side by side with the base 33 of the first terminal 31 in the Y direction. The position of the X1 end of the second terminal 32 and that of the X2 end of the first terminal 31 are equivalent in the X direction.

[Insulating Members 4]

As shown in FIGS. 1, 2, 4 and 5, the insulating members 4 are disposed on the bases 33 of the first and second terminals 31 and 32. The insulating member 4 is formed by molding resin covering each base 33 over the entire periphery. The insulating member 4 is formed substantially over the entirety of each base 33 in the X direction. The base 33 of the first terminal 31 is longer than the base 33 of the second terminal 32 in the X direction and, accordingly, the insulating member 4 disposed on the surface of the base 33 of the first terminal 31 is longer in the X direction than the insulating member 4 disposed on the surface of the base 33 of the second terminal 32.

As shown in FIGS. 4 and 5, the insulating members 4 are on the X1 ends of the cavities 221, and gaps G are formed between the insulating members 4 and the housing 2 in the X direction. Specifically, the insulating members 4 are slightly away from the housing 2 toward the X1 end. As shown in FIGS. 1, 2, 4 and 5, the rib 224 of the housing 2 projects more toward the X1 end than the gaps G between the insulating members 4 and the housing 2. The rib 224 is at a position closer to the X2 end than the connecting portion 34 of each terminal 3.

As shown in FIG. 4, at least a part of each insulating member 4 is at a position between the first and second terminals 31, 32. Specifically, the insulating member 4 disposed on the surface of the base 33 of the first terminal 31 is at least on the surface of the base 33 of the first terminal 31 on the side of the second terminal 32 in the Y direction, and the insulating member 4 disposed on the surface of the base 33 of the second terminal 32 is disposed at least on the surface of the base 33 of the second terminal 32 on the side of the first terminal 31 in the Y direction. At least a part of the insulating member 4 disposed on the base 33 of the first terminal 31 is at a position facing a part of the connecting portion 34 of the second terminal 32 projecting most in the Y direction toward the first terminal 31 in the Y direction.

As shown in FIGS. 1, 3 and 4, the insulating members 4 do not project more toward the sides than the connecting portions 34 in the Y direction. Specifically, the insulating members 4 are located inside both sides of the connecting portions 34 in the Y direction.

As shown in FIGS. 1, 2, 4 and 5, an X2 end of each insulating member 4 overlaps an X1 end of the rib 224 in the Y direction. In this way, the rib 224 is interposed between an entire part on the X2 end from the insulating member 4, out of the part of the first terminal 31 projecting from the housing 2, and an entire part on the X2 end from the insulating member 4, out of the part of the second terminal 32 projecting from the housing 2. In this way, electrical insulation between the first and second terminals 31, 32 can be enhanced.

[Shield Shell 5]

As shown in FIGS. 3 to 5, a shield shell 5 is disposed on an inner peripheral side of the sealing member 14 in the housing 2 and surrounds the first and second terminals 31, 32 over the entire periphery. The shield shell 5 includes a tubular shell body 51 and resilient contact pieces 52 protruding toward the outer peripheral side from the shell body 51.

As shown in FIGS. 4 and 5, the shell body 51 is inserted into the housing 2 in the X direction and surrounds at least parts of the first and second terminals 31, 32 projecting into the mounting portion 21 of the housing 2.

As shown in FIG. 5, the shell body 51 includes a retaining piece 511 partially bent toward the inner peripheral side. The retaining piece 511 faces a step 212 formed on an inner peripheral part of the mounting portion 21 of the housing 2 in the X direction and prevents the shield shell 5 inserted to a predetermined position of the housing 2 from coming out from the housing 2 toward the X1 end.

As shown in FIG. 5, the resilient contact piece 52 is folded from an X1 end of the shell body 51 toward the X2 side. The resilient contact piece 52 is cantilevered on the X1 end part of the shell body 51 and is radially deflectable. The resilient contact piece 52 is formed arcuately to bulge toward the outer peripheral side, and a top part thereof is struck toward the outer periphery side to form a contact point 521. As shown in FIG. 5, the resilient contact pieces 52 are pressed resiliently into contact with the inner surface of the arrangement hole 131 of the case 13 with the connector 1 fastened to the case 13. The case 13 is a conductor and the shield shell 5 is grounded (earthed) to the case 13 by mounting the connector 1 on the case 13.

As described above, a high voltage of about 600 V is applied and a relatively large current flows between the first and second terminals 31, 32. Thus, noise may radiate from the first and second terminals 31, 32. However, the shield shell 5 surrounding the first and second terminals 31, 32 prevents leakage of noise radiated from the terminals 3.

Next, functions and effects of this embodiment are described.

The connecting portion 34 of the first terminal 31 in the connector 1 of this embodiment projects farther from the housing 2 than the connecting portion 34 of the second terminal 32 in the X direction. Specifically, the connecting portions 34 of the first and second terminals 31, 32 are at the positions deviated from each other in the X direction. Thus, two of the connecting portions 34 can be prevented from being excessively near each other due to the side-by-side arrangement of the connecting portions 34 in the Y direction. In this way, electrical insulation between the first and second terminals 31, 32 is ensured. Therefore, the connector 1 is reduced in size by reducing an interval between the first and second terminals 31, 32 in the Y direction.

If the interval between the first and second terminals 31, 32 is reduced in the Y direction, electrical insulation between the first and second terminals 31, 32 may be reduced due to the proximity of the connecting portion 34 of the second terminal 32 and the base 33 of the first terminal 31 in the Y direction.

Accordingly, the insulating member 4 having electrical insulation is disposed at the position adjacent to the connecting portion 34 of the second terminal 32 in the Y direction on the surface of the base 33 of the first terminal 31. Therefore, even if the interval between the first and second terminals 31, 32 is reduced in the Y direction, electrical insulation between the connecting portion 34 of the second terminal 32 and a part of the first terminal 31 arranged side by side in the Y direction can be ensured by the insulating member 4.

Further, the insulating member 4 is a molding resin covering the entire periphery of the base portion 33 and cannot come off from the base 33.

Further, the insulating member 4 is on the surface of the base 33 of the first terminal 31 and also on the surface of the base 33 of the second terminal 32. Therefore, it is possible to ensure electrical insulation between the first and second terminals 31, 32 and electrical insulation between these terminals 3 and a conductive member disposed around them.

The gap G is formed between the insulating member 4 and the housing 2 in the X direction. Thus, the terminal 3 can be mounted into the housing 2 even if the position of the insulating member 4 is not set strictly with respect to the terminal 3. Specifically, in this embodiment, the terminal 3 is inserted into the cavity 221 from the X1 side of the housing 2. Thus, a mounting error possibly occurs in a positional relationship of the housing 2 and the terminal 3 in the X direction. Accordingly, if the gap G is absent, the insulating member 4 may interfere with the housing 2 and it may not be possible to insert the terminal 3 to the predetermined position in the housing 2. On the other hand, since the gap G is provided between the insulating member 4 and the housing 2 in the X direction in this embodiment, the terminal 3 can be mounted easily into the housing 2 even if the position of the insulating member 4 is not set strictly with respect to the terminal 3 in the X direction.

However, if the gaps G are formed as described above, electrical insulation between the first and second terminals 31, 32 may be reduced in a region in the X direction where the gaps G are formed. Accordingly, the housing 2 is formed with the rib 224 interposed between the first and second terminals 31, 32 in the Y direction and projecting to the position overlapping the insulating members 4 in the Y direction. Therefore, it is possible to ensure a creepage distance between the first and second terminals 31, 32 in the region in the X direction where the gaps G are formed and improve electrical insulation between these.

As described above, it is possible to provide a connector capable of ensuring electrical insulation between two terminals even if an interval between the terminals is reduced in an arrangement direction.

The present invention is not limited to the above embodiment and can be applied to various embodiments without departing from the gist thereof. For example, although the parts of the terminals projecting from the housing are straight in one direction, these parts may be bent. In this case, the terminal forming direction indicates a bending direction along the terminals.

Further, the insulating member is not limited to the molding resin and another insulating member such as an insulating sheet can be employed.

Further, although the connecting portion has the circular shape, there is no limitation to this and another shape such as a rectangular shape or U shape can also be employed.

LIST OF REFERENCE SIGNS

1 connector
11 bolt
12 collar
13 case
131 arrangement hole
14 sealing member
2 housing
21 mounting portion
211 first partition wall
212 step
221 cavity
222 locking lance
223 second partition wall
224 rib
231 accommodation groove
22 terminal inserting portion
23 flange
3 terminal
31 first terminal
32 second terminal
33 base
34 connecting portion
341 bolt inserting portion
35 positioning portion
4 insulating member
5 shield shell
51 shell body
511 retaining piece
52 resilient contact
521 contact point portion
9 connector
91 terminal
911 connecting portion
912 bolt inserting portion
92 housing
G gap
L1 (shortest) virtual straight line (connecting portion of first terminal and connecting portion of second terminal)
L2 virtual straight line (parallel to Y direction)
θ angle (between virtual straight line L1 and virtual straight line L2)

What is claimed is:

1. A connector, comprising:

a housing having a terminal insertion portion extending in a terminal forming direction; and a first terminal and a second terminal extending in the terminal forming direction and disposed side by side in an arrangement direction transverse to the terminal forming direction and extending parallel to each other, one end of each of the first and second terminals being inserted into the housing, the other end thereof projecting from the housing, wherein:

each of the first and second terminals includes a base projecting from the housing and a connecting portion formed to be wider toward both sides in the arrangement direction of the first and second terminals than the base and including a bolt inserting portion, the connecting portion of the first terminal projects farther from the housing than the connecting portion of the second terminal in the terminal forming direction along the first and second terminal, and at least one insulating member formed on a surface of the base of the first terminal and being disposed adjacent to the connecting portion of the second terminal in the arrangement direction.

2. The connector of claim 1, wherein the at least one insulating member is formed by molding resin covering an entire periphery of the base.

3. The connector of claim 2, wherein the at least one insulating member comprises a first insulating member disposed on the surface of the base of the first terminal and a second insulating member on a surface of the base of the second terminal.

4. The connector of claim 3, wherein a gap is formed between the insulating members and the housing in the terminal forming direction.

5. The connector of claim 4, wherein the housing is formed with a rib interposed between the first terminal and the second terminal in the arrangement direction and projecting to a position overlapping the insulating members in the arrangement direction.

6. The connector of claim 1, wherein the at least one insulating member comprises a first insulating member disposed on the surface of the base of the first terminal and a second insulating member on a surface of the base of the second terminal.

7. The connector of claim 6, wherein a gap is formed between the insulating members and the housing in the terminal forming direction.

8. The connector of claim 7, wherein the housing is formed with a rib interposed between the first terminal and the second terminal in the arrangement direction and projecting to a position overlapping the insulating members in the arrangement direction.

* * * * *